US011313099B2

(12) United States Patent
Jin et al.

(10) Patent No.: US 11,313,099 B2
(45) Date of Patent: Apr. 26, 2022

(54) FLEXIBLE JOINT CONNECTING DEVICE OF PRECAST BODY SEGMENT, PRECAST BODY SEGMENT JOINING-TYPE UNDERWATER TUNNEL CONSTRUCTION METHOD USING SAME, AND UNDERWATER TUNNEL CONSTRUCTED THEREBY

(71) Applicant: DAEWOO ENGINEERING & CONSTRUCTION CO., LTD, Seoul (KR)

(72) Inventors: Byeong Moo Jin, Suwon-si (KR); Je Chun Kim, Seoul (KR); Kyoungo Kim, Yongin-si (KR); Kyung Tae Bae, Seoul (KR); Kyoungwon Seo, Suwon-si (KR); Youseok Kim, Seoul (KR); Yong Jic Kim, Suwon-si (KR); Hyun Su Park, Uiwang-si (KR)

(73) Assignee: DAEWOO ENGINEERING & CONSTRUCTION CO., LTD, Seoul (KR)

( * ) Notice: Subject to any disclaimer, the term of this patent is extended or adjusted under 35 U.S.C. 154(b) by 0 days.

(21) Appl. No.: 17/424,923

(22) PCT Filed: Nov. 28, 2019

(86) PCT No.: PCT/KR2019/016616

§ 371 (c)(1),
(2) Date: Jul. 22, 2021

(87) PCT Pub. No.: WO2020/153595

PCT Pub. Date: Jul. 30, 2020

(65) Prior Publication Data

US 2022/0098818 A1 Mar. 31, 2022

(30) Foreign Application Priority Data

Jan. 23, 2019 (KR) ..... 10-2019-0008736

(51) Int. Cl.
*E02D 29/067* (2006.01)

(52) U.S. Cl.
CPC .... *E02D 29/067* (2013.01); *E02D 2250/0061* (2013.01); *E02D 2300/002* (2013.01); *E02D 2600/20* (2013.01)

(58) Field of Classification Search
CPC ..... E21D 11/083; E02D 29/067; E02D 29/07; E02D 29/073; E02D 29/077;
(Continued)

(56) References Cited

U.S. PATENT DOCUMENTS 3,910,058 A * 10/1975 Fouillade ..... E02D 25/00 405/147
4,095,435 A * 6/1978 Uemura ..... E21D 9/0621 405/138
(Continued)

FOREIGN PATENT DOCUMENTS

JP 11-229414 A 8/1999
JP 2005-264674 A 9/2005
(Continued)

*Primary Examiner* — Benjamin F Fiorello
(74) *Attorney, Agent, or Firm* — Goldilocks Zone IP Law

(57) ABSTRACT

The present disclosure relates to: a flexible joint connecting device used for sequentially coupling precast concrete segments so as to construct an underwater tunnel; an underwater tunnel construction method using the flexible joint connecting device so as to join, in a watertight manner, tunnel modules and integrally connect same, thereby constructing the underwater tunnel; and the underwater tunnel constructed by the construction method.

4 Claims, 18 Drawing Sheets

(58) Field of Classification Search
CPC ..... E02D 2300/002; E02D 2500/0061; E02D 2600/20
See application file for complete search history.

(56) References Cited

U.S. PATENT DOCUMENTS

| | | | | | |
|---|---|---|---|---|---|
| 4,444,526 | A * | 4/1984 | Foundoukos | E02D 29/063 405/158 |
| 5,540,522 | A * | 7/1996 | Launaro | E02D 29/067 52/167.1 |
| 5,899,635 | A * | 5/1999 | Kuja | E02D 29/067 405/134 |
| 10,253,904 | B1 * | 4/2019 | Lin | F16L 1/26 |
| 2010/0310318 | A1 * | 12/2010 | Hertgers | E02D 29/063 405/134 |

FOREIGN PATENT DOCUMENTS

| | | | |
|---|---|---|---|
| KR | 10-0797795 | B1 | 1/2008 |
| KR | 10-2009-0107333 | A | 10/2009 |
| KR | 10-0921188 | B1 | 10/2009 |
| KR | 10-1059297 | B1 | 8/2011 |
| KR | 10-2013-0115921 | A | 10/2013 |
| KR | 10-1710565 | B1 | 2/2017 |

* cited by examiner

FLEXIBLE JOINT CONNECTING DEVICE OF PRECAST BODY SEGMENT, PRECAST BODY SEGMENT JOINING-TYPE UNDERWATER TUNNEL CONSTRUCTION METHOD USING SAME, AND UNDERWATER TUNNEL CONSTRUCTED THEREBY

CROSS-REFERENCE TO RELATED APPLICATION

This application claims the benefit under 35 U.S.C. Section 371, of PCT International Application No. PCT/KR2019/016616, filed on Nov. 28, 2019, which claimed priority to Korean Patent Application No. KR10-2019-0008736, filed on Jan. 23, 2019, the disclosures of which are hereby incorporated by the references.

TECHNICAL FIELD

This disclosure relates to a method for constructing an underwater tunnel through which vehicles or pedestrians may path, an underwater tunnel constructed by the construction method, and a flexible joint connecting device used therefor. This disclosure corresponds to the research results of a research project (title: Smart Submerged Floating Tunnel Research Center) of the Ministry of Science and ICT (Project Unique No. 2017R1A5A1014883/Management Agency: National Research Foundation).

BACKGROUND ART

An underwater tunnel is constructed under water for the passage of vehicles and pedestrians. The underwater tunnel may be constructed by sequentially joining precast concrete segments. The precast concrete segments manufactured on land are transported to a construction site by floating on the water surface in a state where both longitudinal ends of the precast concrete segments are sealed. The precast concrete segments are submerged in water and connected to an end portion of the underwater tunnel that is already constructed in the water, thereby forming the underwater tunnel. At this time, the precast concrete segments submerged in the water should be moved toward the end portion of the underwater tunnel, and at a position close to the end portion, the precast concrete segments should be aligned and connected to the end portion of the underwater tunnel. At this time, accurate and precise joining between the precast concrete segments and the end portion of the underwater tunnel should be sufficiently ensured.

DISCLOSURE

Technical Problem

This disclosure is directed to providing a technology that enables precise and safe construction by, when constructing an underwater tunnel by sequentially combining precast concrete segments, reducing the hassle and inaccuracy of the joining work caused by individually submerging the plurality of precast concrete segments and joining them in water.

This disclosure is directed to providing a technology that enables economical underwater tunnel construction by reducing construction costs and shortening the construction period of the underwater tunnel.

Technical Solution

In the present disclosure, there is provided a flexible joint connecting device for connecting the precast concrete segments of an underwater tunnel to be rotationally bendable in a vertical direction and then coupling the precast concrete segments to be in contact with each other.

In the present disclosure, there is provided an underwater tunnel construction method, which constructs an underwater tunnel by submerging a tunnel module, which is manufactured by connecting precast concrete segments to each other by a flexible joint connecting device, in water and then joining the tunnel module to an end portion of the underwater tunnel.

In the present disclosure, there is provided an underwater tunnel constructed by the underwater tunnel construction method using the flexible joint connecting device.

Advantageous Effects

In the present disclosure, since the work of forming a tunnel module by integrally joining and integrally connecting a plurality of precast concrete segments is performed in advance on the water surface, the work may be easily performed at an increased speed, and the water-tightening work between the precast concrete segments may also be performed more perfectly.

In the present disclosure, since a plurality of precast concrete segments are integrally combined to form the tunnel module, the tunnel module may have a linearity that more accurately matches with the designed one. Therefore, it is possible to easily and accurately join the precast concrete segment assembly to the end portion of the underwater tunnel, and there is an advantage that the construction is performed more precisely and safely.

BEST MODE

Figure 1:
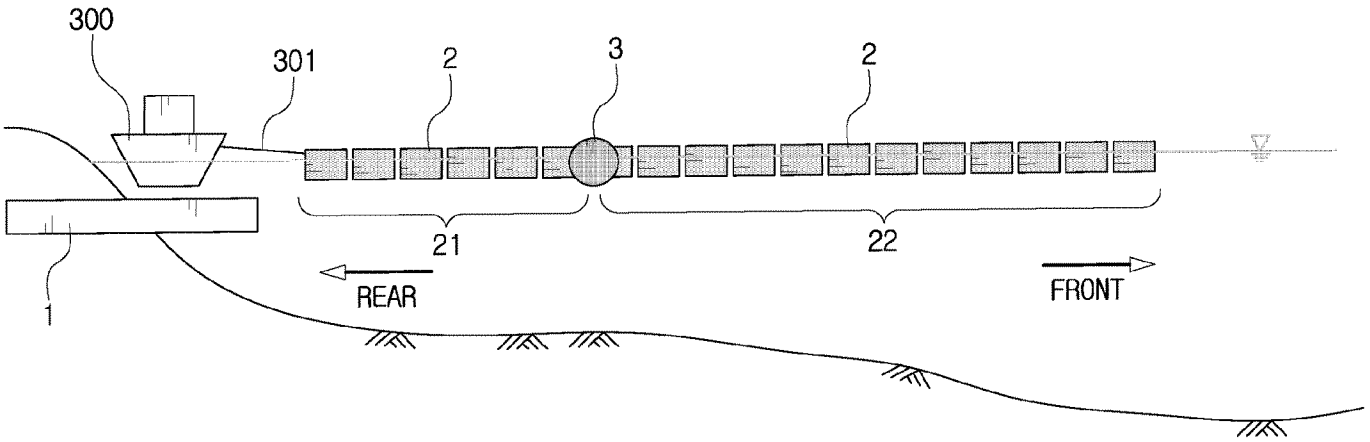
FIGS. 1 to 6 are schematic views sequentially showing the process of constructing an underwater tunnel by using a construction method according to the present disclosure, respectively.

In the present disclosure, there is provided a flexible joint connecting device for temporarily connecting precast concrete segments to each other in order to construct an underwater tunnel, the flexible joint connecting device comprising first and second joining modules respectively coupled to a pair of precast concrete segments facing each other and connected to each other by an expansion/contraction device, wherein each of the first and second joining modules is integrally coupled to the precast concrete segment while surrounding an outer side of the precast concrete segment, wherein the expansion/contraction device is an expandable and shrinkable member that is longitudinally disposed between the first and second joining modules facing each other, wherein the first joining module includes a hinge fixing member so that one end of the expansion/contraction device is hinged to the hinge fixing member to be vertically rotatable, wherein the second joining module includes an end fastening member that is vertically rotatable, and wherein as the pair of precast concrete segments approach toward each other, the other end of the expansion/contraction device is fastened to the end fastening member so that the first and second joining modules are integrally connected by the expansion/contraction device, whereby the pair of precast concrete segments respectively having the first and second joining modules are connected to be vertically bendable with respect to each other, and, when the expansion/contraction device is contracted, the precast concrete segments are pulled toward each other so that ends thereof come into contact.

In the flexible joint connecting device of the present disclosure as above, the first and second joining modules may be configured to include an outer frame member in which a pair of bent frame members having a "⌊" shape, which is rotated by 90 degrees such that an open portion is oriented downward, are positioned to face each other with an interval in a longitudinal direction and are integrated with each other by a crosslinking member, a first expansion jack and a second expansion jack connected to be rotatable with respect to each other by a rotating hinge link may be positioned between the pair of bent frame members at both lateral sides of the outer frame member, the rotating hinge link may be configured to be movable along the vertical portion of the bent frame, the other end of the first expansion jack may be rotatably coupled to a top of the vertical portion of the bent frame member, a bottom opening/closing beam made of a beam member extending laterally may be rotatably coupled to the bottom of the vertical portion of the bent frame member so that the bottom opening/closing beam protrudes outward further to the vertical portion of the bent frame member, a bottom end of the second expansion jack may be rotatably coupled to the protruding portion of the bottom opening/closing beam, and when each of the first and second joining modules is coupled to the precast concrete segment, both the first expansion jack and the second expansion jack may be contracted to move the opening/closing beam to an opening location so that a lower portion of the outer frame member is opened, then the joining module is moved downward so that the precast concrete segment is inserted into the open lower portion of the outer frame member, and then both the first expansion jack and the second expansion jack may be expanded to horizontally rotate the opening/closing beam so that the precast concrete segment is completely surrounded by the joining module, and when each of the first and second joining modules is separated from the precast concrete segment, both the first expansion jack and the second expansion jack may be contracted to move the opening/closing beam to an opening location so that the lower portion of the outer frame member is opened, and then the joining module may be moved upward so that the precast concrete segment deviates from the open lower portion of the outer frame member.

In order to accomplish the above object, in the present disclosure, there is provided a method of constructing an underwater tunnel by coupling precast concrete segments, the method comprising: forming a tunnel module by integrally connecting a plurality of floating precast concrete segments in a state where both longitudinal ends of the precast concrete segments are sealed, wherein a plurality of tunnel modules are formed to float and are temporarily connected to each other by a flexible joint connecting device that allows vertical displacement; submerging a first tunnel module positioned close to a end portion in water among the plurality of tunnel modules; when a rear end of the submerged first tunnel module faces the end portion, temporarily connecting the rear end of the first tunnel module to the end portion by using the flexible joint connecting device; submerging a second tunnel module successive to the first tunnel module in water; connecting and joining the end portion and the first tunnel module in a perfect watertight manner to be integrated; and submerging a third tunnel module successive to the submerged second tunnel module in water, and connecting and joining two precast concrete segment assemblies in a perfect watertight manner to be integrated, which is repeated such that a plurality of tunnel modules are integrally coupled to construct an underwater tunnel.

In the present disclosure, the flexible joint connecting device according to the present disclosure is used for temporarily connecting the tunnel modules and temporarily connecting the front end of the first tunnel module to the end portion to construct an underwater tunnel.

In the present disclosure, there is provided an underwater tunnel constructed by the above method of the present disclosure.

MODE FOR INVENTION

FIGS. 1 to 4 are schematic views sequentially showing the process of constructing an underwater tunnel by using a construction method according to the present disclosure, respectively. In FIGS. 1 to 4, an end portion 1 of the underwater tunnel and each precast concrete segment 2 are depicted briefly. A flexible joint connecting device 3 is briefly illustrated with a simple circle in FIGS. 1 to 4. The flexible joint connecting device 3 temporarily connects an end portion 1 and a tunnel module. The flexible joint connecting device 3 also connects tunnel modules to each other.

An underwater tunnel of the present disclosure has a configuration in which precast concrete segments having a predetermined length in a longitudinal direction are continuously integrally coupled. The precast concrete segment 2 is made of a concrete member having a hollow space through which vehicles or persons may pass. The precast concrete segment 2 is made on land or on a ship.

As shown in FIG. 1, the precast concrete segment 2 is provided to float on the water surface in a state where both longitudinal ends thereof are sealed. A plurality of floating precast concrete segments are integrally joined and connected completely to make one tunnel module. Subsequently, the tunnel modules are temporarily connected by a flexible joint connecting device 3 that allows vertical displacement (bending in a vertical direction). The work of connecting the tunnel modules 21, 22 to each other by using the flexible joint connecting device 3 and the work of making the precast concrete segment 2 to float are performed in a proper order depending on the situation of the construction site. In FIG. 1, a reference number 300 designates a tugboat 300 for allowing the precast concrete segment 2 to float and be transported to a construction site. In FIG. 1, a reference number 301 designates a pulling cable 301 for connecting the tugboat 300 to the precast concrete segment 2.

The plurality of tunnel modules connected to each other by the flexible joint connecting device 3 are sequentially expressed as a first tunnel module 21 and a second tunnel module 22 in a direction gradually away (a front direction) from a position closer to the end portion 1 of the underwater tunnel. A third tunnel module, a fourth tunnel module, and the like may be further provided. The end portion 1 of the underwater tunnel has already been constructed in the water. FIGS. 1 to 4 show as if, in one tunnel module, there is a gap between the precast concrete segments 2 and thus the precast concrete segments 2 are separated from each other. However, FIGS. 1 to 4 depicted as above are just to distinguish the precast concrete segment 2. In the present disclosure, as described above, the plurality of precast concrete segments 2 are integrated in contact with each other to form a tunnel module.

In a state where a plurality of tunnel modules are temporarily connected by the flexible joint connecting device 3, two neighboring tunnel modules may be bent at an angle in a vertical direction with respect to each other but may not be displaced in a lateral or longitudinal direction. The configuration and operation of the flexible joint connecting device 3 will be described later.

Figure 2:
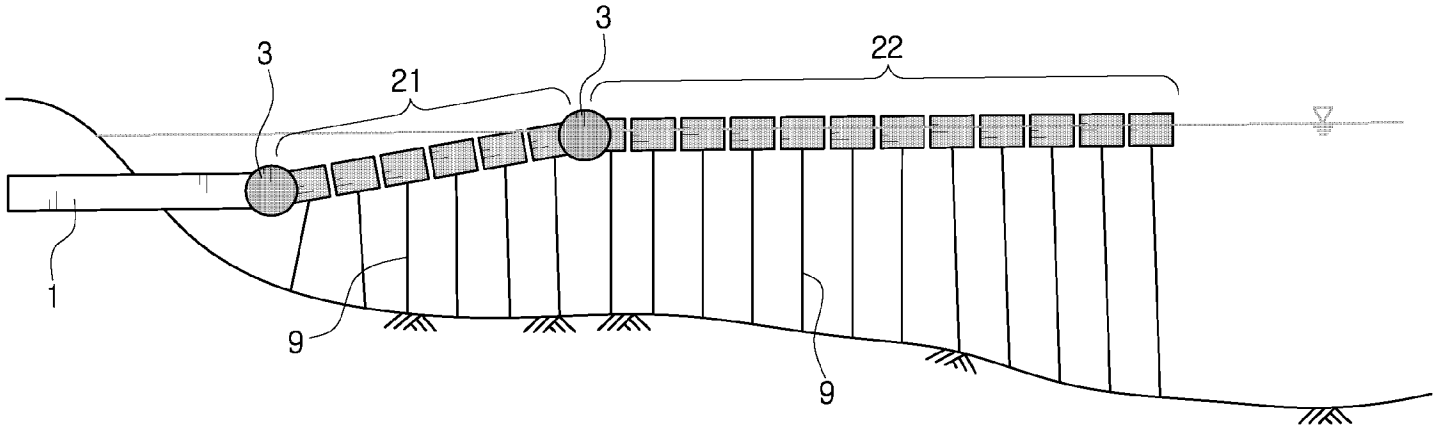

Along with that a plurality of tunnel modules, namely the first tunnel module 21 and the second tunnel module 22, are temporarily connected by the flexible joint connecting device 3, or before or after that, the other end of a tethering wire 9 whose one end is coupled to the seabed ground and extends in a vertical direction is connected to the tunnel modules 21, 22, respectively, as shown in FIG. 2. That is, the seabed ground and the tunnel modules 21, 22 are connected to each other by the tethering wire 9. It is not necessary to connect the tethering wire 9 to every precast concrete segment 2 in each tunnel module. The tethering wire 9 may be installed in an appropriate number according to the situation.

Subsequently, the first tunnel module 21 at a position close to the end portion 1 is submerged as shown in FIG. 2. Since the tethering wire 9 is coupled to the first tunnel module 21, it is possible to easily submerge the first tunnel module 21 into the water by pulling the tethering wire 9.

If the rear end of the submerged first tunnel module 21 faces the end portion 1, the rear end of the first tunnel module 21 and the end portion 1 are temporarily connected using the flexible joint connecting device 3. The second tunnel module 22 is located behind the first tunnel module 21. The end portion 1 is located underwater, but the second tunnel module 22 may be floating on the water surface. Therefore, when the rear end of the first tunnel module 21 and the end portion 1 are temporarily connected, the first tunnel module 21 is inclined so that its rear portion is under the water and its front portion is on the water surface as shown in FIG. 2. The flexible joint connecting device 3 is installed between the rear end of the first tunnel module 21 and the end portion 1. Further another flexible joint connecting device 3 is installed between the front end of the first tunnel module 21 and the rear end of the second tunnel module 22. Accordingly, as shown in FIG. 2, the end portion 1, the first tunnel module 21, and the subsequent second tunnel module 22 remain integrally connected.

Figure 3:
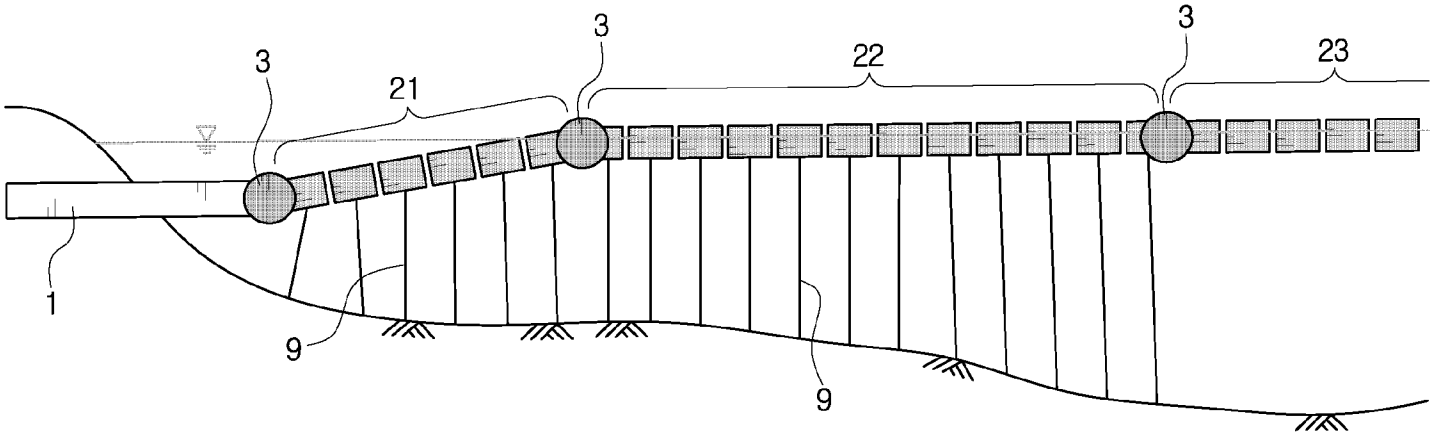

It is also possible that another tunnel module, namely the third tunnel module 23, is provided to float in front of the second tunnel module 22 and be connected thereto in advance. However, as shown in FIG. 3, it is also possible that the third tunnel module 23 is connected to the second tunnel module 22 after the end portion 1 and the first tunnel module 21 are connected. The flexible joint connecting device 3 is also installed between the second and third tunnel modules 22, 23.

Figure 4:
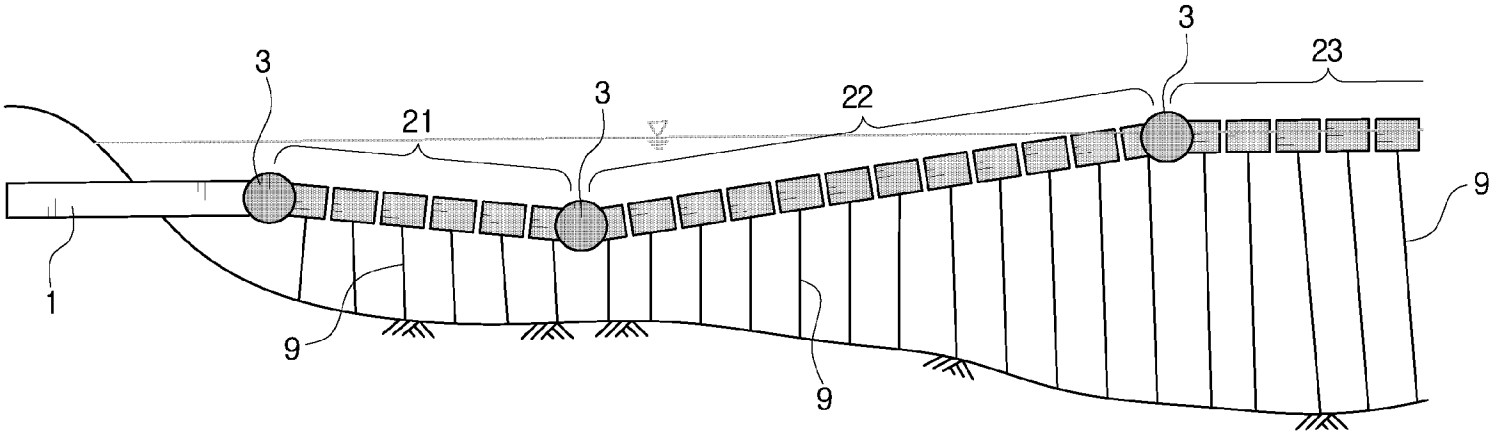

Subsequently, the second tunnel module 22 is submerged in water as shown in FIG. 4. The tethering wire 9 is also coupled to the second tunnel module 22. Therefore, the second tunnel module 22 may be easily submerged in the water by pulling the tethering wire 9. when the second tunnel module 22 is submerged in the water, the flexible joint connecting device 3 provided between the first and second tunnel modules 21, 22 is also submerged into the water. Due to the flexible joint connecting device 3 provided between the end portion 1 and the first tunnel module 21, the first tunnel module 21 may be rotationally displaced while being vertically bent with respect to the end portion 1. Therefore, the first tunnel module 21 is vertically displaced to be positioned in a designed linear form with the end portion 1.

Figure 5:
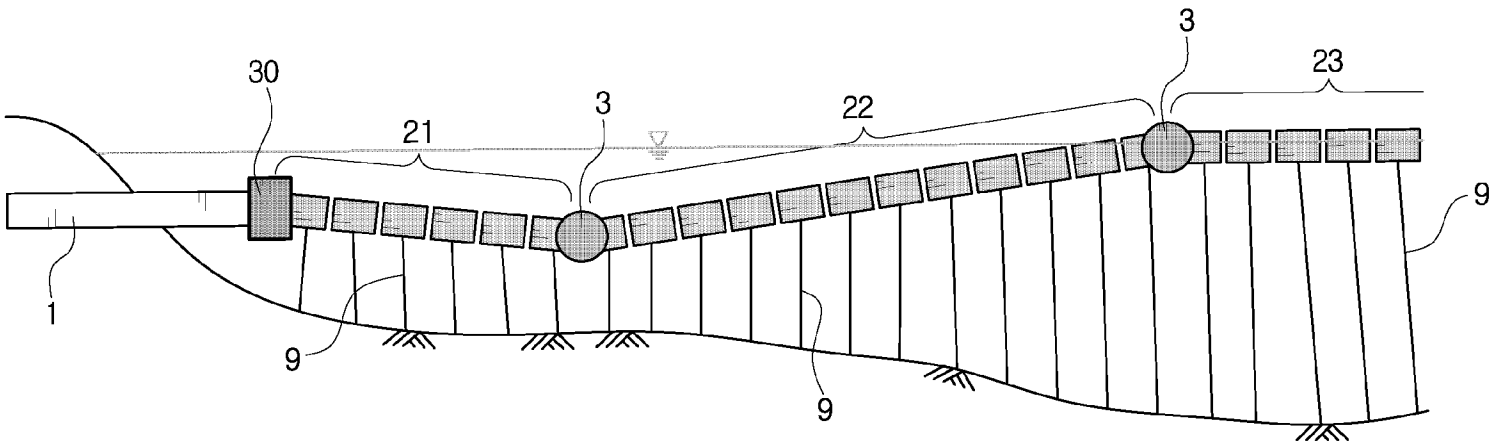

When the second tunnel module 22 is also submerged in the water, the first tunnel module 21 is aligned to make a designed linear form with the end portion 1 at a designed depth. In addition, the end portion 1 and the first tunnel module 21 may maintain an aligned state in the designed linear form. The end portion 1 and the first tunnel module 21 are connected and joined in a completely watertight manner so that they are not bent or separated any longer. After the end portion 1 and the first tunnel module 21 are integrated, the flexible joint connecting device installed therebetween may be removed. FIG. 5 shows a state where which the end portion 1 and the first tunnel module 21 are integrally coupled. In FIG. 5, the part where the end portion 1 and the first tunnel module 21 are integrally coupled is expressed as a "coupling joint 30", and is shown as a rectangle indicated by a reference number 30 in the drawing.

Figure 6:
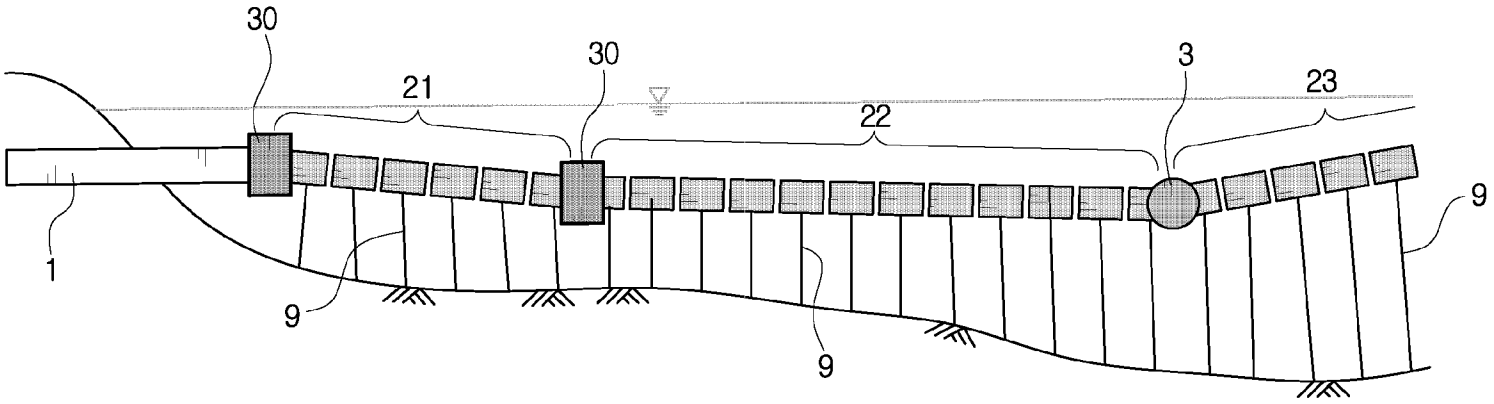

Subsequently, as shown in FIG. 6, the third tunnel module 23 is also submerged in water by pulling the tethering wire 9 coupled to the third tunnel module 23. Accordingly, the second tunnel module 22 is completely submerged in the water and aligned at a designed position in a designed depth. After the first tunnel module 21 and the second tunnel module 22 are integrated by being connected and joined in a complete watertight manner, the flexible joint connecting device installed therebetween is removed. In the present disclosure, this process is repeated a required number of times to construct an underwater tunnel.

According to the construction method of the present disclosure, an underwater tunnel is constructed using a plurality of precast concrete segments. The tunnel module is prepared in advance by joining and connecting a plurality of precast concrete segments integrally in advance on the water surface. The work of connecting and joining the plurality of precast concrete segments integrally is performed not in water but on the surface of the water. Therefore, according to the present disclosure, the work for the construction of an underwater tunnel may be performed more easily, and the work speed may be improved. In addition, the present disclosure has an advantage that the work for connecting the precast concrete segments in a watertight manner may be more perfectly performed. In particular, since the plurality of precast concrete segments are integrally coupled to form a tunnel module, the tunnel module may have a linearity that more accurately matches the designed one. Therefore, there is also an advantage that the adjustment of linearity of the entire underwater tunnel may be performed very easily.

Next, the flexible joint connecting device 3 used in the construction method of the present disclosure will be described.

Figure 7:
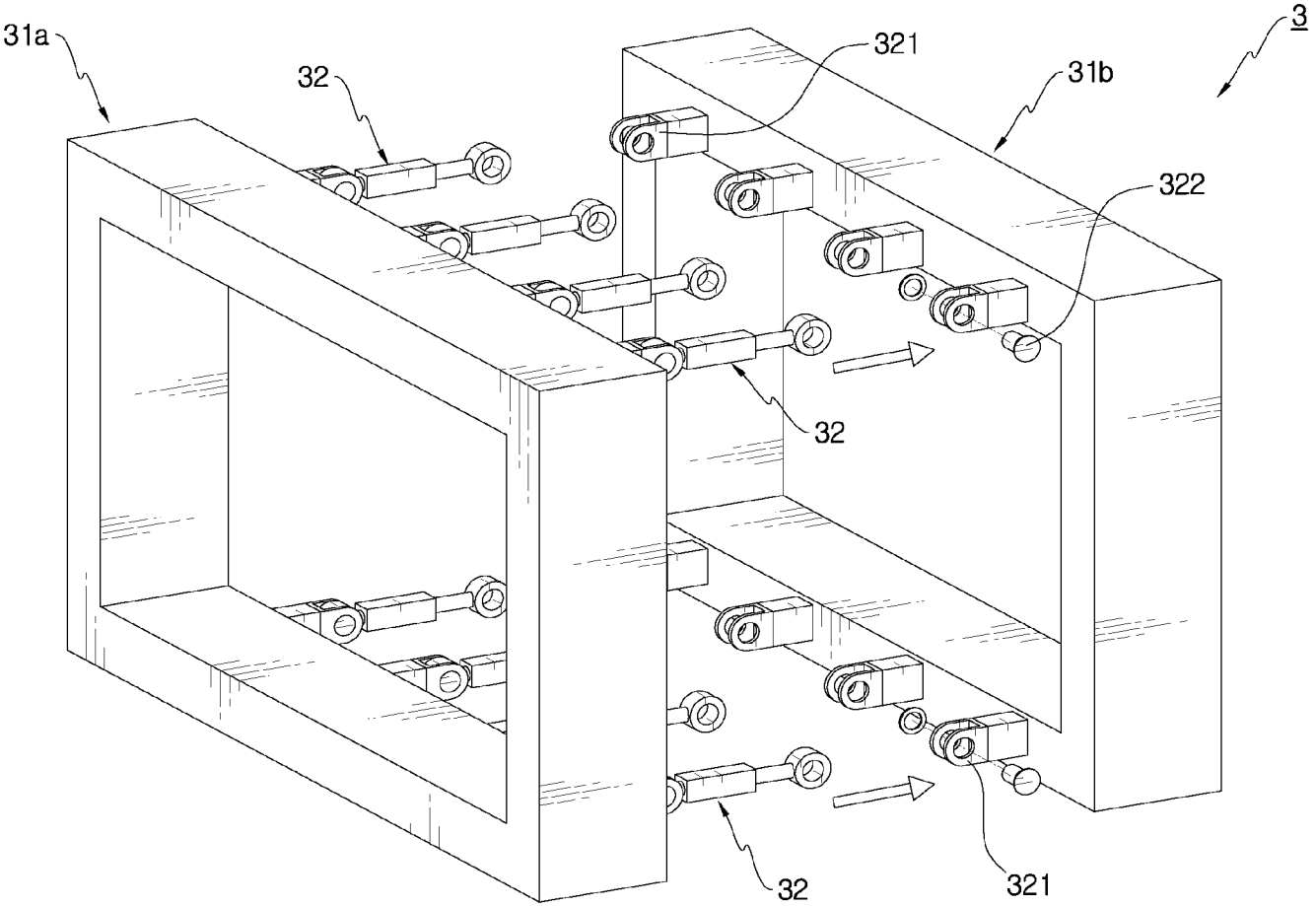
FIGS. 7 and 8 are schematic perspective views showing a flexible joint connecting device according to the first embodiment of the present disclosure in different directions.
Figure 8:
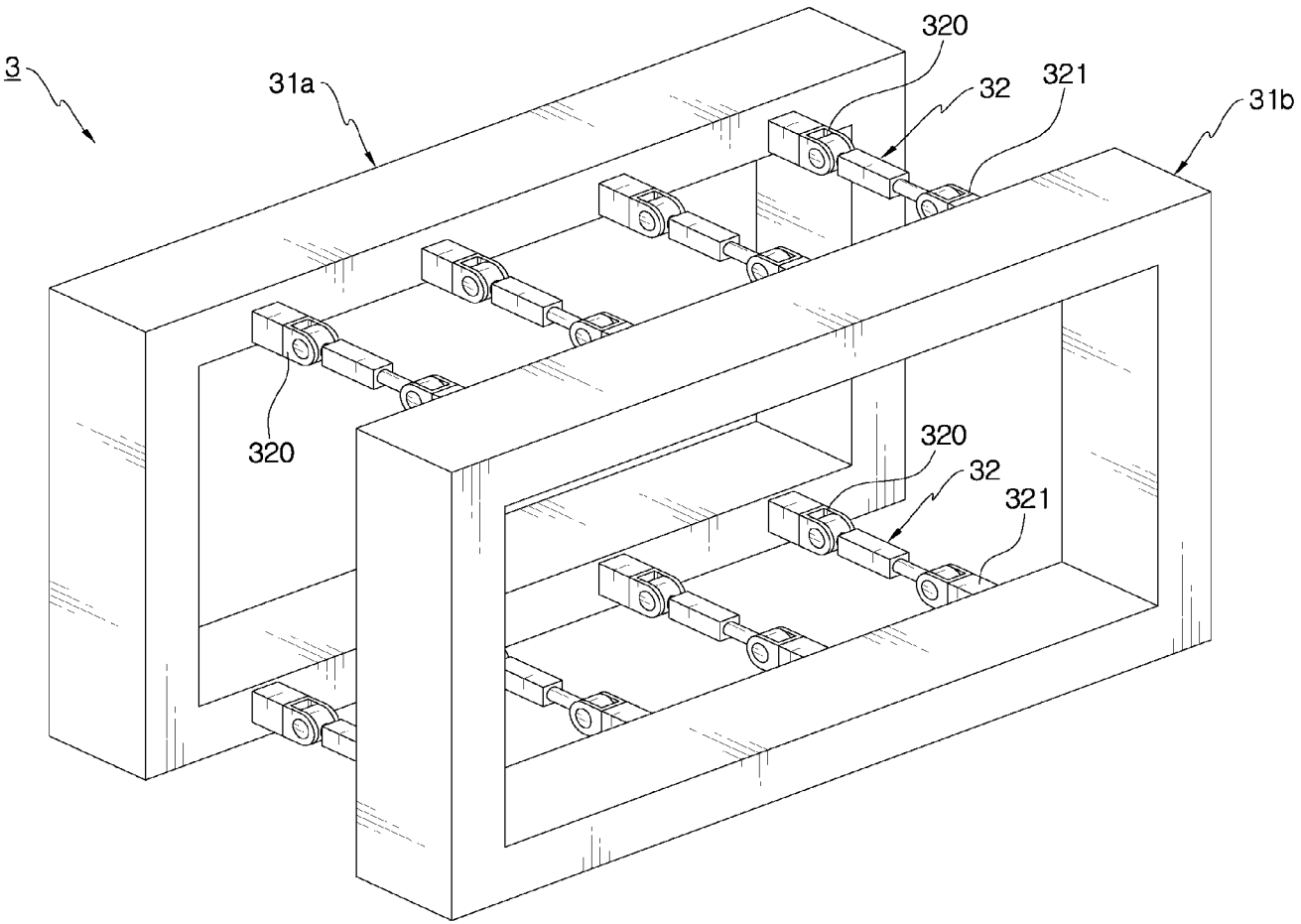
Figure 9:
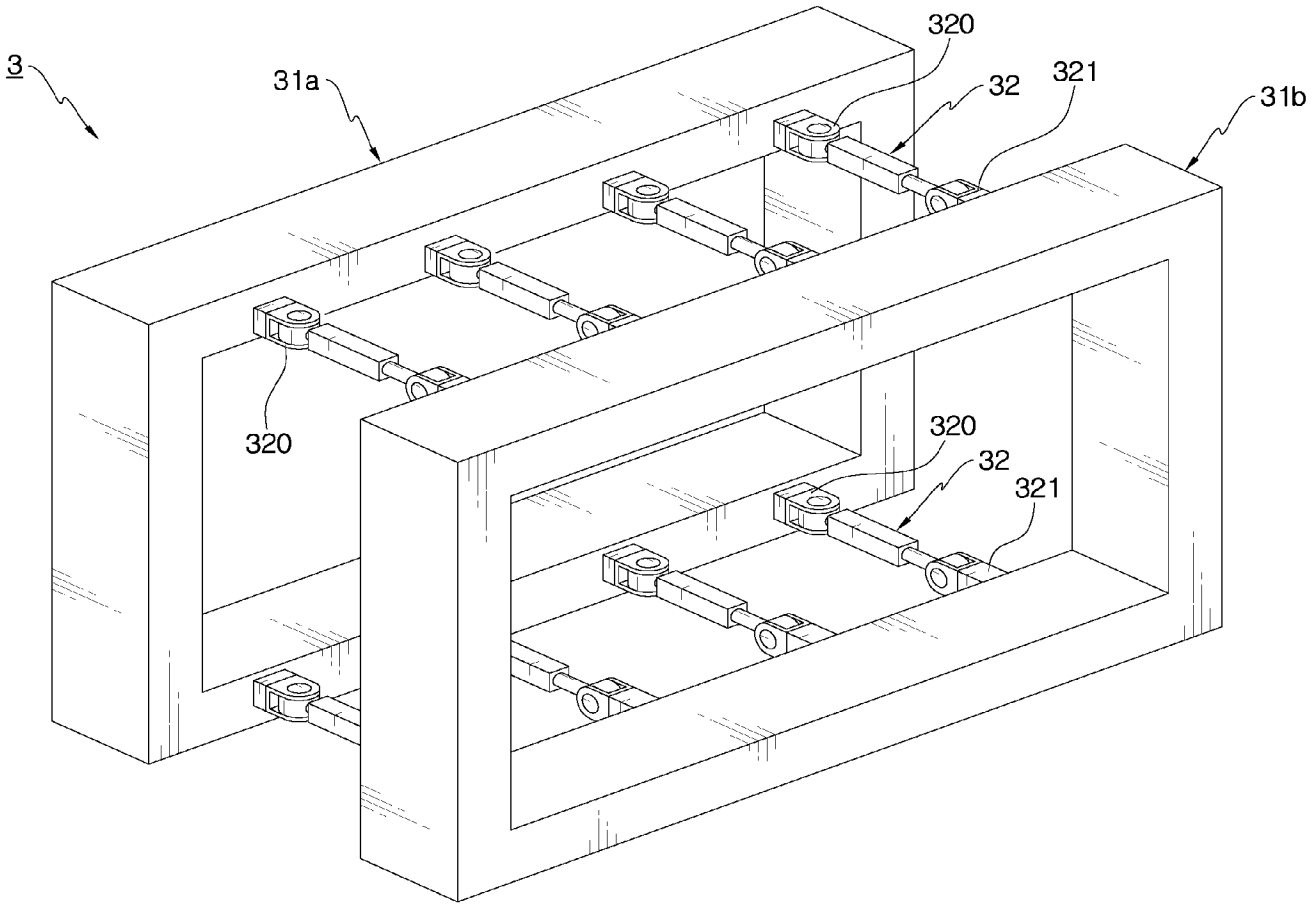
FIG. 9 is a schematic perspective view corresponding to FIG. 8 to show that a hinge fixing member and an expansion/contraction device are coupled in a laterally bendable state, as a modification of the first embodiment of the present disclosure.

FIGS. 7 and 8 are schematic perspective views showing the flexible joint connecting device 3 according to the first embodiment of the present disclosure in different directions. FIG. 7 shows a state where a pair of joining modules 31*a*, 31*b* of the flexible joint connecting device 3 are not yet coupled to each other. FIG. 8 shows a state where the pair of joining modules 31*a*, 31*b* are coupled to each other. FIG. 9 is a schematic perspective view corresponding to FIG. 8 and shows that a hinge fixing member and an expansion/contraction device are coupled in a state of allowing lateral bending rotation, by modifying the first embodiment of the present disclosure.

Figure 10:
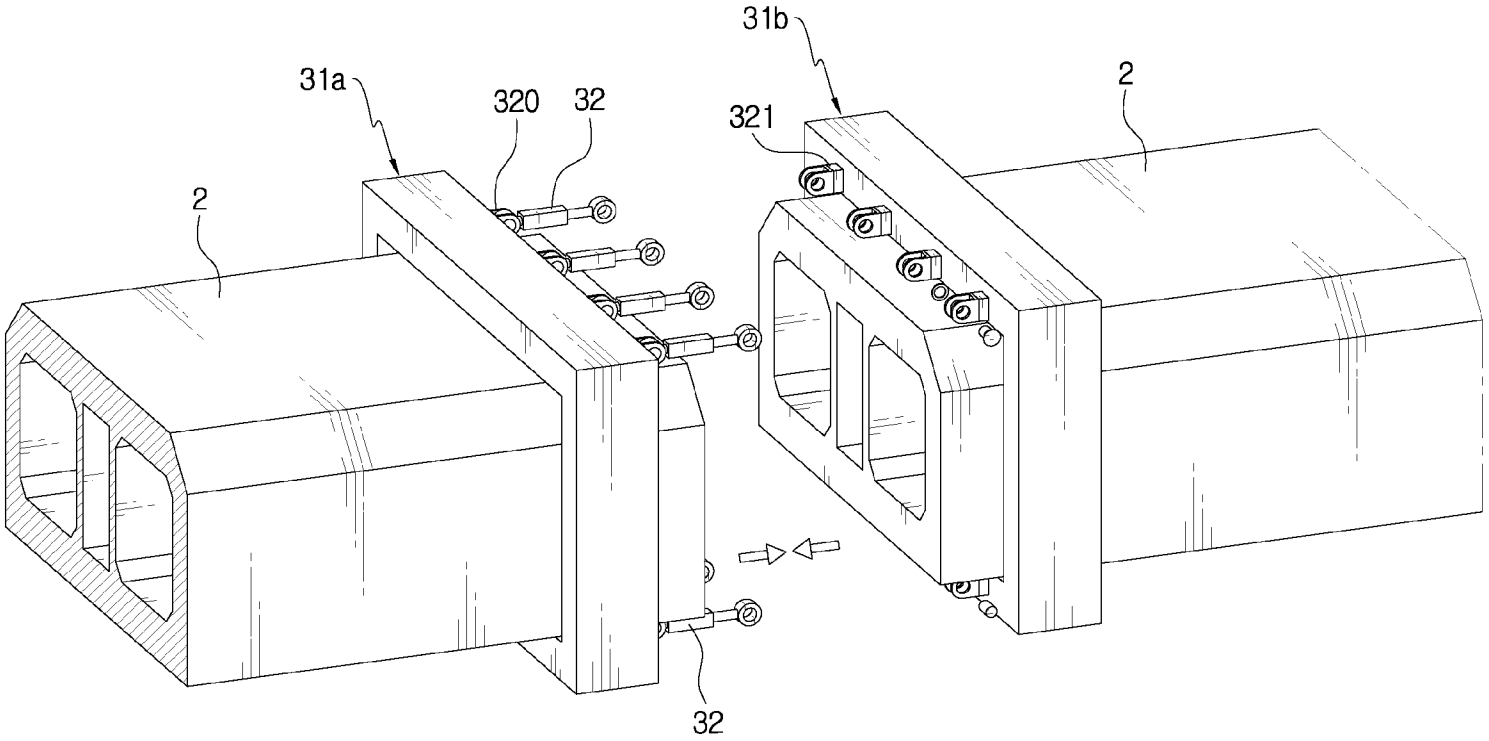
FIGS. 10 to 12 are schematic perspective views sequentially showing that two precast concrete segments are coupled by the flexible joint connecting device according to the first embodiment of the present disclosure, respectively.
Figure 11:
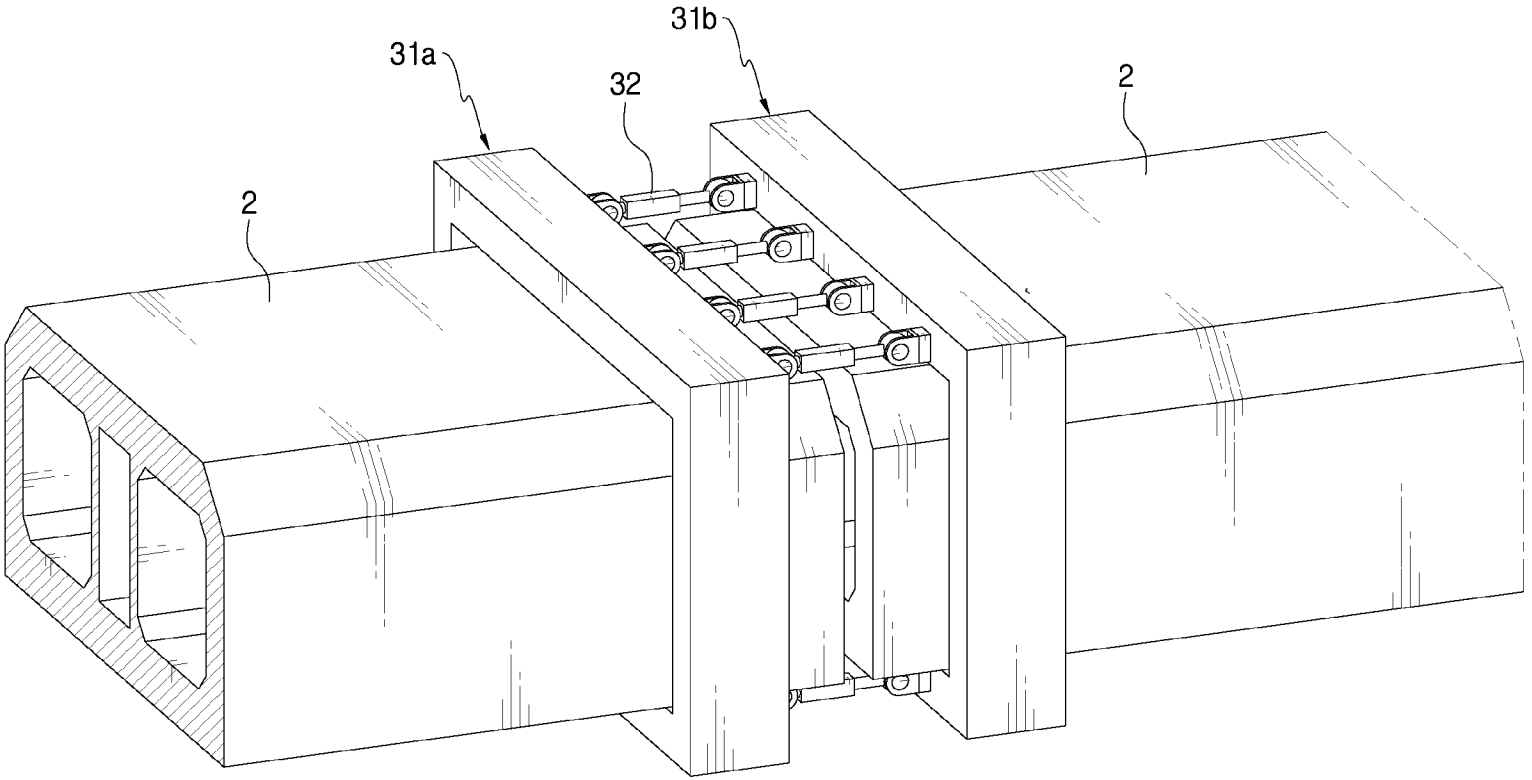
Figure 12:
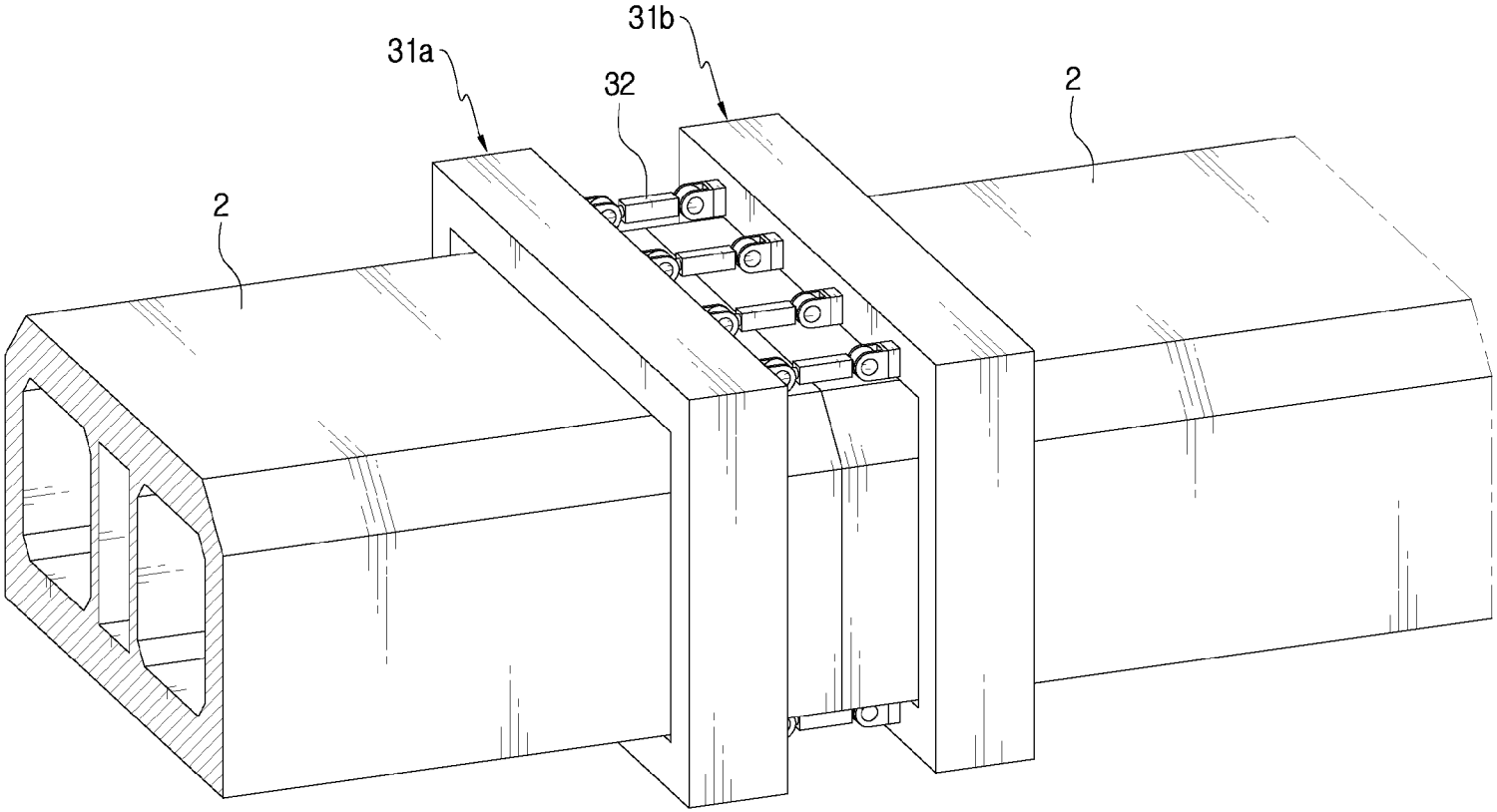

FIGS. 10 to 12 are schematic perspective views sequentially showing that two precast concrete segments 2 are coupled by the flexible joint connecting device 3 according to the first embodiment of the present disclosure, respectively. In FIG. 10, the joining modules 31*a*, 31*b* of the flexible joint connecting device 3 are installed to the precast concrete segments 2, respectively, but the two precast concrete segments 2 are not close enough to be integrated in contact with each other, so the two joining modules 31*a*, 31*b* are not yet connected. In FIG. 11, subsequent to the state of FIG. 10, the joining modules 31*a*, 31*b* are connected to each other, but the two precast concrete segments 2 are still spaced apart. In FIG. 12, subsequent to the state of FIG. 11, the joining modules 31*a*, 31*b* are pulled to each other so that the two precast concrete segments 2 are connected in contact with each other.

The flexible joint connecting device 3 includes a pair of joining modules 31*a*, 31*b* that are respectively coupled to the pair of precast concrete segments 2 facing each other to surround the outer sides thereof. The pair of joining modules 31*a*, 31*b* are connected by an expansion/contraction device 32 and are pulled closer to each other by the contraction of the expansion/contraction device 32. When the pair of joining modules 31*a*, 31*b* are called individually to be distinguished from each other, they are referred to separately as a first joining module 31*a* and a second joining module 31*b*.

Each of the joining modules 31*a*, 31*b* includes an outer frame member integrally coupled to the precast concrete segment 2 while surrounding the outer portion of the precast concrete segment 2 in close contact therewith, as shown in FIGS. 7 to 12. In the first embodiment shown in FIGS. 7 to 12, the outer frame member is configured to surround all four sides of the precast concrete segment 2 having a rectangular cross section, like a closed ring member.

The pair of joining modules 31*a*, 31*b* are installed to face each other at the ends of the precast concrete segments 2 to be connected. The expansion/contraction device 32 capable of expanding and contracting is arranged in the longitudinal direction between the pair of joining modules 31*a*, 31*b* facing each other. One end of the expansion/contraction device 32 is coupled to the outer frame member of the first joining module 31*a*. The other end of the expansion/contraction device 32 is coupled to the outer frame member of the second joining module 31*b*. In the embodiment shown in the drawings, an end fastening member 321 is fixedly installed to the outer frame member of the second joining module 31*b* facing the first joining module 31*a*. The other end of the expansion/contraction device 32 is coupled to the end fastening member 321. Therefore, the expansion/contraction device 32 is coupled to enable rotational bending in the vertical direction at the outer frame member of the second joining module 31*b*. In the drawings, a reference number 322 designates a rotation coupling pin 322 for coupling the other end of the expansion/contraction device 32 to the end fastening member 321 to be rotationally bendable in a vertical direction. The end fastening member 321 may be provided in plural at an upper portion and a lower portion of the outer frame member of the second joining module 31*b*.

A hinge fixing member 320 is also provided to the front side of the outer frame member of the first joining module 31*a*. One end of the expansion/contraction device 32 may be hinged to the hinge fixing member 320. In the embodiment shown in FIG. 8, the hinge fixing member 320 and one end of the expansion/contraction device 32 are coupled so that the expansion/contraction device 32 may be rotated in the vertical direction. In this configuration, both the hinge fixing member 320 and the end fastening member 321 may rotate in the vertical direction. Therefore, in a state where both ends of the expansion/contraction device 32 are coupled to the hinge fixing member 320 and the end fastening member 321, respectively, bending rotation in the vertical direction is possible. However, if necessary, as described later, while the expansion/contraction device 32 is contracting to make the precast concrete segments 2 approach each other so that both ends of the precast concrete segments come into contact with each other, it may be necessary to move the precast concrete segments laterally within a limited range. To this end, if necessary, the hinge fixing member 320 and the expansion/contraction device 32 may be coupled in a joint form that also allows lateral bending and rotation. As exemplarily shown in FIG. 9, the direction of the hinge fixing member 320 may be selected to allow lateral rotation. According to this configuration, while the precast concrete segments are being joined, the precast concrete segments may be bent in the lateral direction. Of course, it is also possible to couple the hinge fixing member 320 and the expansion/contraction device 32 in a universal joint form that allows both vertical and lateral bending rotation. Along with this or instead of this, the end fastening member 321 and the expansion/contraction device 32 may be coupled in a joint form that allows lateral bending and rotation, or a universal joint. In FIGS. 10 to 12 and in FIGS. 13 to 18 showing the second embodiment of the present disclosure, explained later, for convenience, it is depicted that the hinge fixing member 320 and the expansion/contraction device 32 are coupled using what is illustrated in FIG. 8.

The first and second joining modules 31*a*, 31*b* and the expansion/contraction device 32 are fixedly installed to the precast concrete segments 2 to be connected to each other, respectively. At this time, as shown in FIGS. 7 and 10, in a state where the two precast concrete segments 2 do not approach sufficiently close to each other yet, the other end of the expansion/contraction device 32 simply exists as a free end. As exemplarily shown in the drawings, the expansion/contraction device 32 has one end fixed to the outer frame member of the first joining module 31*a* and the other end facing the second joining module 31*b*, but in a state where the two precast concrete segments 2 do not approach sufficiently close to each other yet, the other end of the expansion/contraction device 32 is only facing the second joining module 31*b*. Subsequently, when the precast concrete segments 2 approach each other, the other end of the expansion/contraction device 32, which has existed as a free end, is fastened to the end fastening member 321 of the second joining module 31*b*. Accordingly, the first and second joining modules 31*a*, 31*b* are integrally connected by the expansion/contraction device 32. In addition, as shown in FIG. 11, the precast concrete segments 2 adjacent to each other in the longitudinal direction are connected to each other by the flexible joint connecting device 3.

The two precast concrete segments 2 connected to each other by the flexible joint connecting device 3 may be bent at a predetermined angle in the vertical direction with respect to each other. The expansion/contraction device 32 may be contracted to reduce its length. As shown in FIG. 11, if the expansion/contraction device 32 contracts after both ends of the expansion/contraction device 32 are coupled to the first and second joining modules 31*a*, 31*b*, respectively, the precast concrete segments 2 approach each other more, and eventually, as shown in FIG. 12, the precast concrete segments are connected in a state where both ends of the precast concrete segments are in contact with each other.

The end portion 1 of the underwater tunnel is actually made using a precast concrete segment. Therefore, as described above with reference to FIG. 2, the first tunnel module 21 positioned close to the end portion 1 is submerged in water and temporarily connected to the end portion 1. At this time, in a state where the joining module of the flexible joint connecting device 3 is installed to the first tunnel module 21 and the end portion 1, respectively, the first tunnel module 21 is allowed to approach the end portion 1, so that the expansion/contraction device 32 connects both joining modules. By doing so, a "structure of connecting the end portion 1 and the first tunnel module 21 by the flexible joint connecting device 3" is made. In the state shown in FIG. 10, bending rotation in the vertical direction is possible in a state where both ends of the expansion/contraction device 32 are coupled to the hinge fixing member 320 and the end fastening member 321, respectively. Therefore, the end portion 1 and the first tunnel module 21 are connected to each other, and the first tunnel module 21 may make rotational displacement while being bent vertically with respect to the end portion 1. Accordingly, like the state of FIG. 2 described above, the first tunnel module 21 may be temporarily connected to the end portion 1 in a tilted state so that its rear portion is under the water and its front portion is on the water surface. Also, since the first tunnel module 21 may make rotational displacement while being bent vertically with respect to the end portion 1, as described with reference to FIG. 4, when the second tunnel module 22 is submerged in water, the first tunnel module 21 makes rotational displacement vertically again to be positioned in a designed linear form with the end portion 1.

If the expansion/contraction device 32 is contracted to pull the end portion 1 and the first tunnel module 21 closer to each other, the end portion 1 and the first tunnel module 21 come into complete contact with each other. As described above in relation to FIG. 5, when the end portion 1 and the first tunnel module 21 are integrated by being connected and joined in a perfect watertight manner, the expansion/contraction device 32 is contracted so that the end portion 1 and the first tunnel module 21 come into complete contact with each other. After the end portion 1 and the first tunnel module 21 come into contact with each other, the end portion 1 and the first tunnel module 21 are completely integrally connected and joined in a watertight state by a known method.

The flexible joint connecting device 3 of the above structure may be installed between the first tunnel module 21 and the second tunnel module 22, between the second tunnel module 22 and the third tunnel module 23, and also between subsequent tunnel modules. That is, after the flexible joint connecting device 3 is installed to temporarily connect the tunnel modules to each other, the tunnel modules are aligned to have a designed linearity with each other by rotational bending displacement in the vertical direction at the flexible joint connecting device 3, and then the expansion/contraction device 32 is contracted to bring the tunnel modules into contact with each other and completely connecting and joining the tunnel modules in a perfect watertight manner.

In the case of the flexible joint connecting device 3 according to the first embodiment shown in FIGS. 7 to 12, the outer frame member of the joining module has a ring member structure that is completely closed. Therefore, after the joining module is installed to surround the outer side of the precast concrete segment, it is not possible to remove the joining module without cutting the outer frame member of the joining module. Also, the joining module of this configuration should be installed to each precast concrete segment in advance. However, in the case of the flexible joint connecting device 3 according to the second embodiment of the present disclosure to be described later, it is possible to remove the joining module from the precast concrete segment, and there is an advantage that the joining module does not need to be installed in advance.

Figure 13:
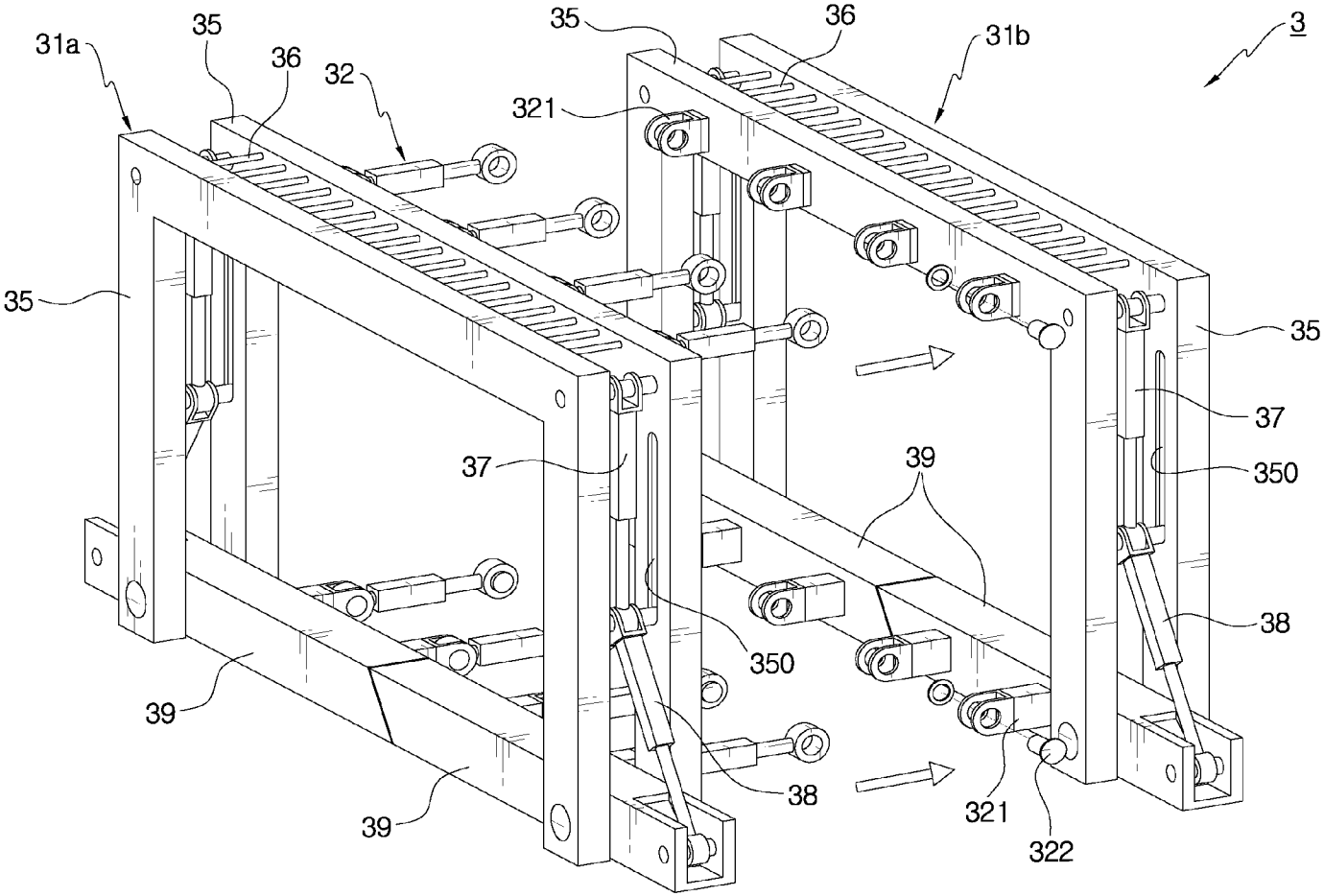
FIGS. 13 and 14 are schematic perspective views showing a flexible joint connecting device according to the second embodiment of the present disclosure in different directions.
Figure 14:
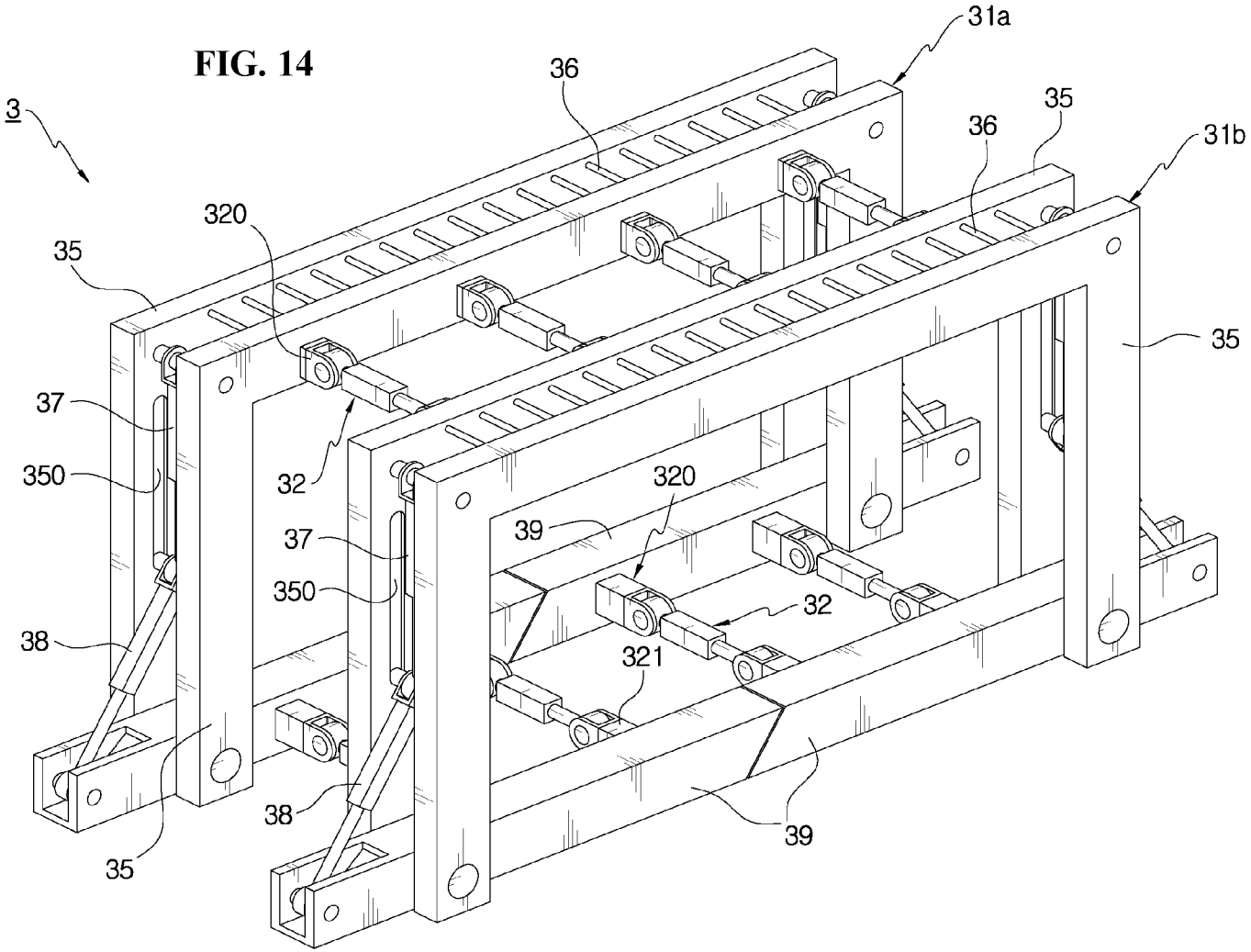
Figure 15:
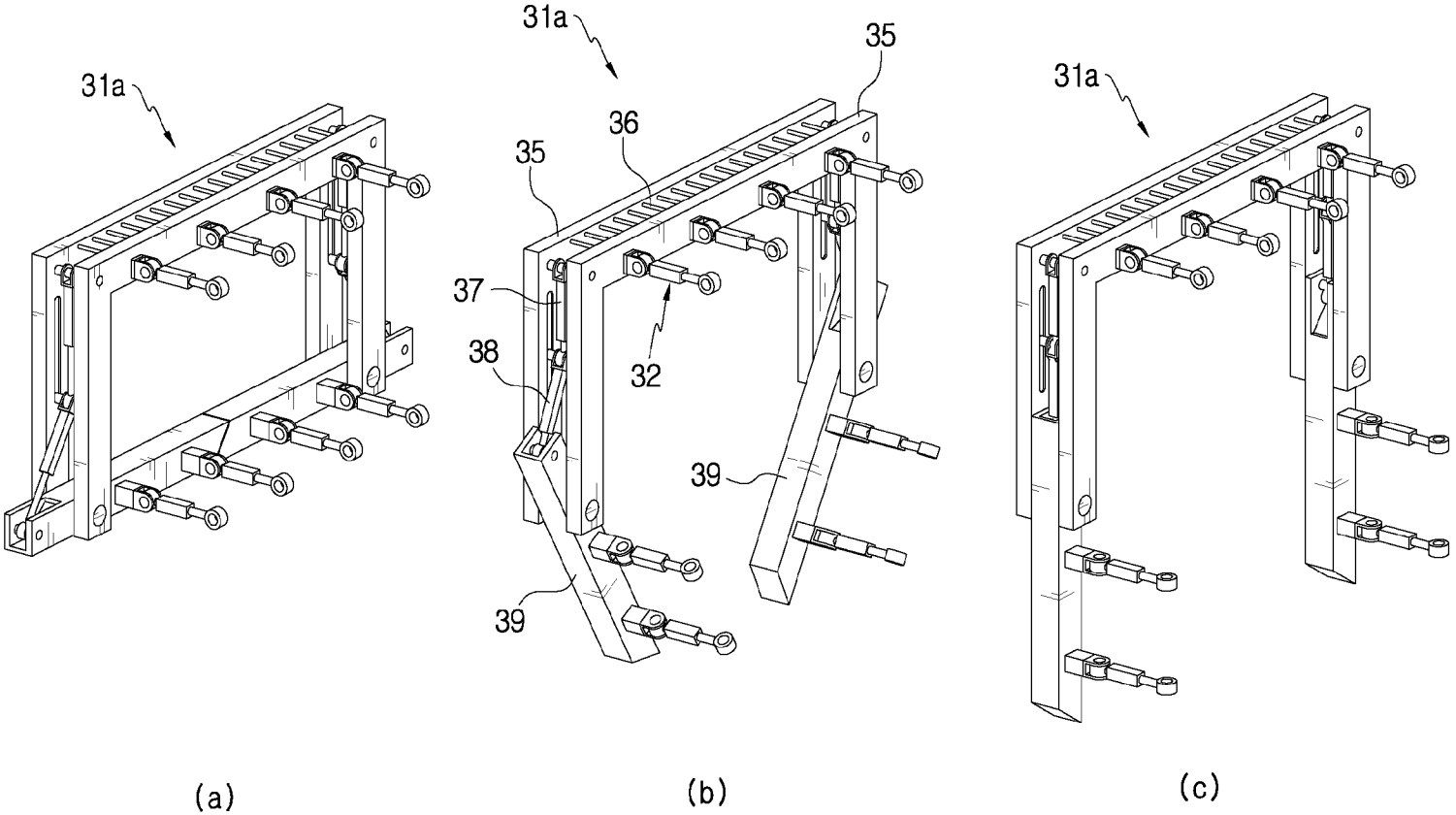
FIG. 15 is a schematic perspective view sequentially showing the process of opening and closing a bottom end of an openable joining module provided to the flexible joint connecting device according to the second embodiment of the present disclosure.

FIGS. 13 and 14 are schematic perspective views showing the flexible joint connecting device 3 according to the second embodiment of the present disclosure in different directions. FIG. 13 shows a state where the pair of joining modules 31*a*, 31*b* of the flexible joint connecting device 3 are not yet coupled to each other. FIG. 14 shows a state where the pair of joining modules 31*a*, 31*b* are coupled to each other. FIG. 15 is a schematic perspective view sequentially showing the process of opening and closing a lower end of an openable joining module provided to the flexible joint connecting device 3 of the second embodiment. For convenience, in FIG. 15, only the first joining module 31*a* is shown among the pair of openable joining modules provided to the flexible joint connecting device 3. However, the second joining module 31*b* also has a configuration in which a lower end is opened and closed in the same way as the first joining module 31*a*.

Figure 16:
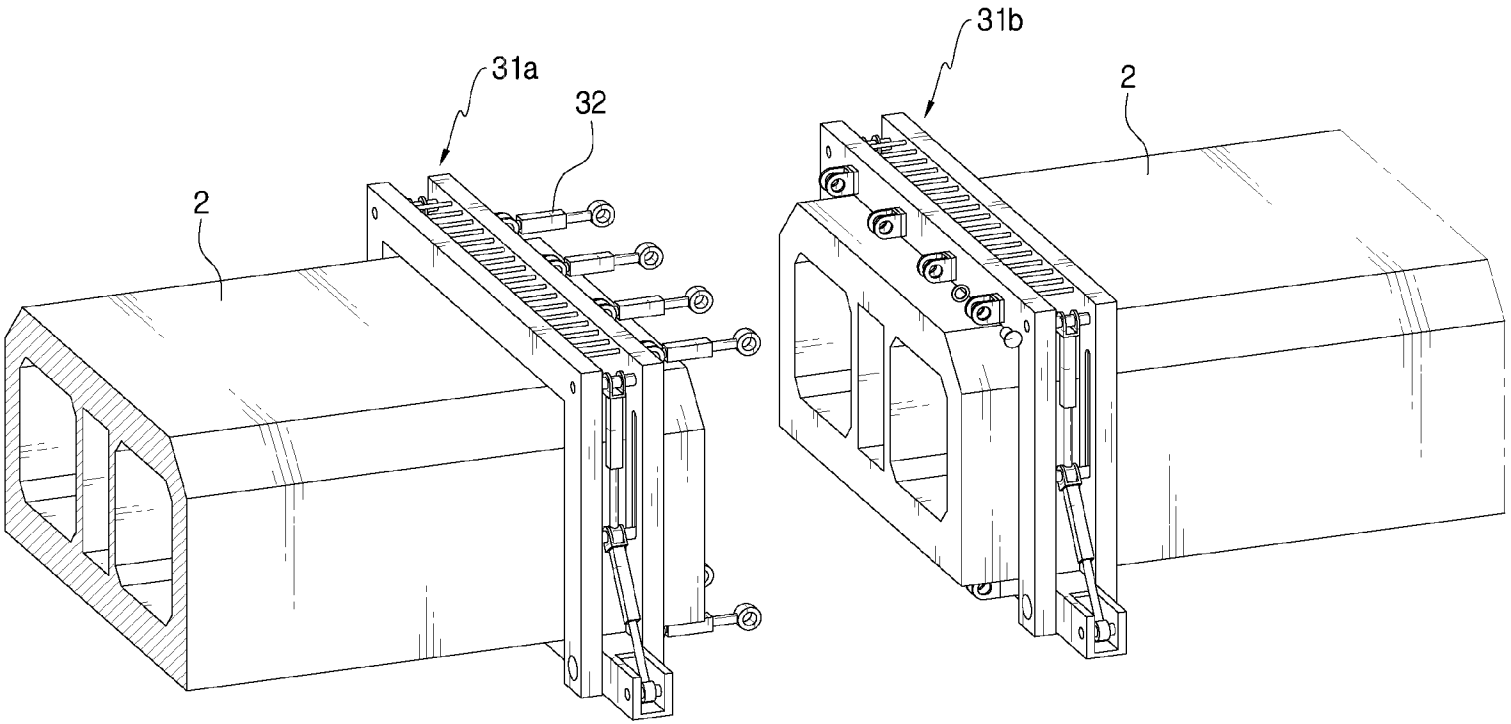
FIGS. 16 to 18 are schematic perspective views sequentially showing that two precast concrete segments are coupled by the flexible joint connecting device according to the second embodiment of the present disclosure, respectively.
Figure 17:
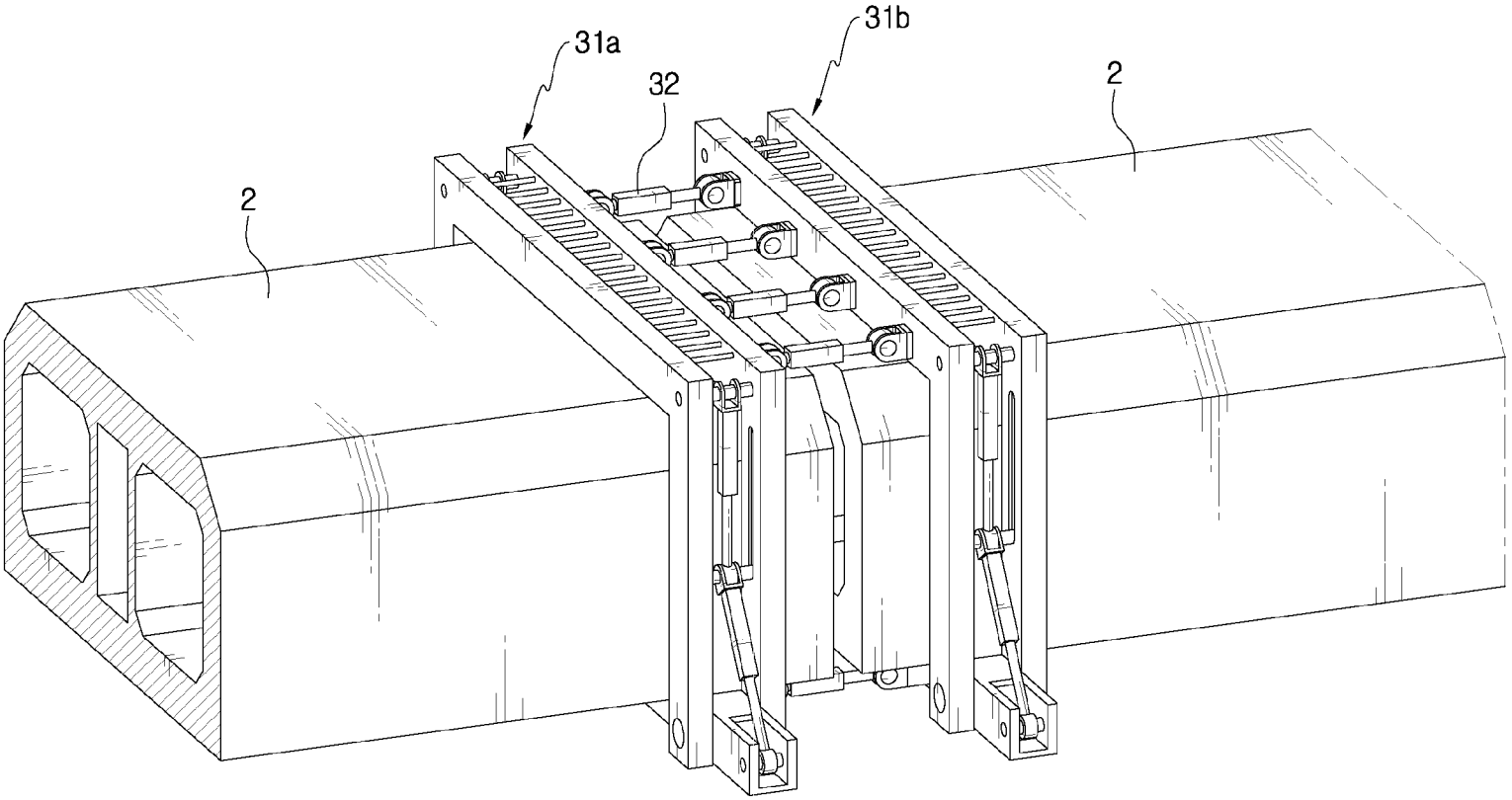
Figure 18:
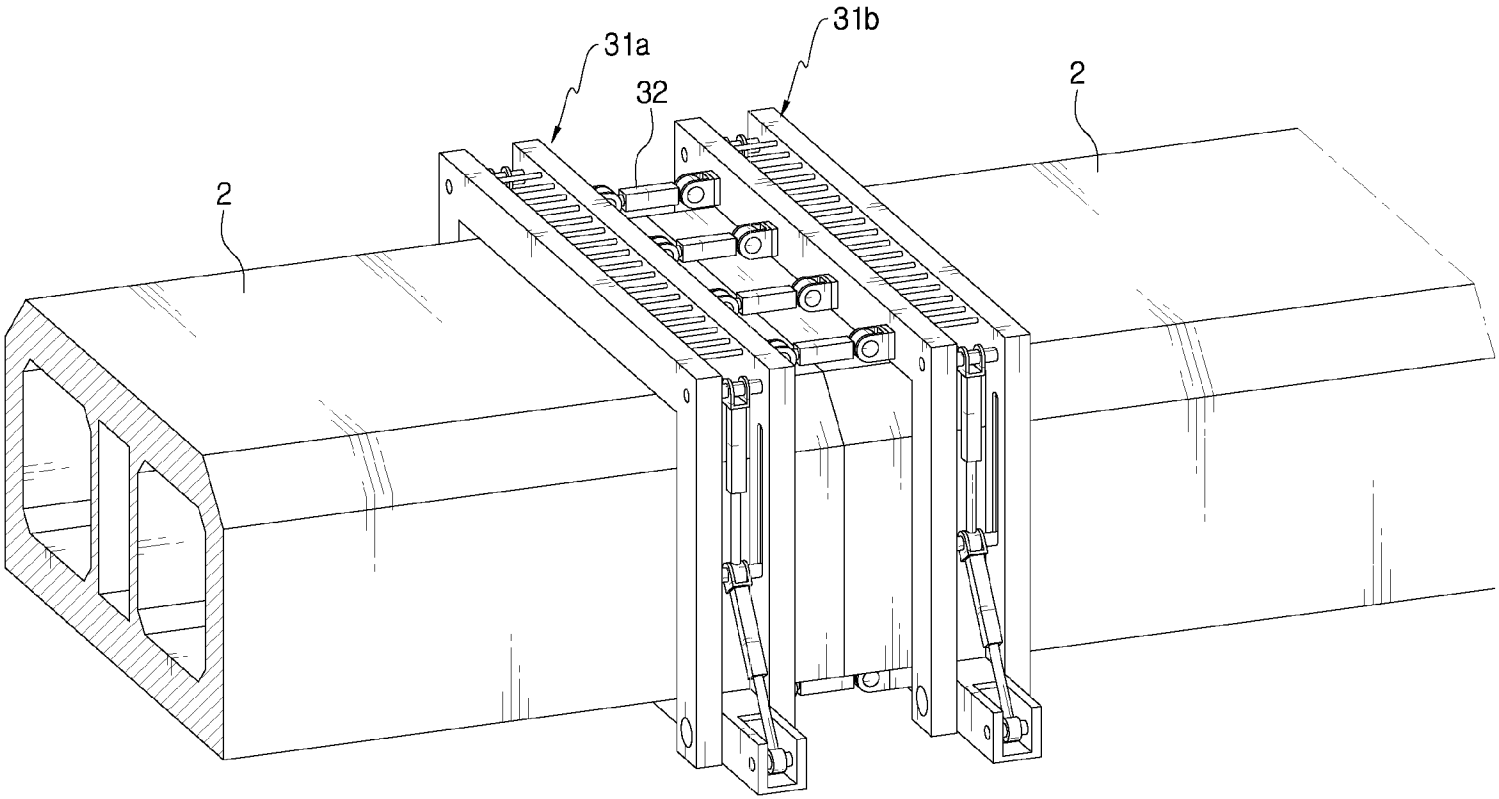

FIGS. 16 to 18 are schematic perspective views sequentially showing that two precast concrete segments 2 are coupled by the flexible joint connecting device 3 according to the second embodiment of the present disclosure, respectively. In FIG. 16, the joining modules 31*a*, 31*b* of the flexible joint connecting device 3 are installed to the precast concrete segments 2, respectively, but the two precast concrete segments 2 do not approach close enough to be contacted and integrated so that the joining modules 31*a*, 31*b* are not yet connected. In FIG. 17, subsequent to the state of FIG. 16, the joining modules 31*a*, 31*b* are connected to each other, but the two precast concrete segments 2 are still spaced apart. In FIG. 18, subsequent to the state of FIG. 17, the joining modules 31*a*, 31*b* are pulled toward each other so that the two precast concrete segments 2 are connected in contact with each other.

Like the first embodiment described above, the flexible joint connecting device 3 according to the second embodiment of the present disclosure as shown in FIGS. 13 to 18 also includes a pair of joining modules 31*a*, 31*b* respectively coupled to the pair of precast concrete segments 2 facing each other while surrounding the outer sides of the pair of precast concrete segments 2 and pulled closer to each other by the expansion/contraction device 32. Each of the joining modules 31*a*, 31*b* includes an outer frame member that is integrally coupled to the precast concrete segment 2 while surrounding the outer side of the precast concrete segment 2. Both ends of the expansion/contraction device 32 are coupled to the hinge fixing member 320 and the end fastening member 321, and the expansion/contraction device 32 connects the pair of joining modules 31*a*, 31*b*. Therefore, the same configuration, function and effect of the flexible joint connecting device 3 of the second embodiment and the flexible joint connecting device of the first embodiment will not described in detail again.

In the flexible joint connecting device 3 according to the second embodiment of the present disclosure, unlike the first embodiment, the lower portion of the joining module surrounding the outer side of the precast concrete segment 2 is configured to be opened and closed. The outer frame member of the first and second joining modules 31*a*, 31*b* provided to the flexible joint connecting device 3 includes a pair of bent frame members 35 having a "⌊" shape, which is rotated by 90 degrees such that an open portion is oriented downward, and the pair of bent frame members 35 are positioned to face each other with an interval in a longitudinal direction. The outer frame members are integrated with each other by a crosslinking member 36. An elongated hole 350 is formed in the vertical portion of the bent frame member 35. A first expansion jack 37 and a second expansion jack 38 are located in the gap between the pair of bent frame members 35. The first expansion jack 37 and the second expansion jack 38 are rotatably connected to each other by a rotating hinge link 351. The rotating hinge link 351 is coupled to the elongated hole 350 so as to be movable up and down in the vertical direction along the elongated hole 350. The other end of the first expansion jack 37 is rotatably coupled to the top of the vertical portion of the bent frame member 35. At the lower end of the vertical portion of the bent frame member 35, a bottom opening/closing beam 39 made of a beam member extending in the lateral direction is rotatably coupled. The bottom opening/closing beam 39 protrudes outward further to the vertical portion of the bent frame member 35. The bottom of the second expansion jack 38 is rotatably coupled to the protruding part of the bottom opening/closing beam 39. The first expansion jack 37, the second expansion jack 38 and the bottom opening/closing beam 39 are respectively provided to be equally symmetrical at both lateral sides of the outer frame member.

In order to install the joining module of the flexible joint connecting device 3 having the above configuration to the precast concrete segment, first, both the first expansion jack 37 and the second expansion jack 38 are contracted. If the first expansion jack 37 is contracted, the rotating hinge link 351 rises vertically while being inserted into the elongated hole 350. At this time, if the second expansion jack 38 is also contracted, the protruding part of the bottom opening/closing beam 39 is pulled upward by the seesaw operation, so that the opening/closing beam 39 rotates to stand upright to an open position. Accordingly, the lower portion of the outer frame member of the joining module is completely opened. That is, the state shown in FIG. 15(*a*) is changed to the state of FIG. 15(*b*) by the contraction of the first expansion jack 37 and the second expansion jack 38, and finally the lower portion of the outer frame member becomes fully opened as shown in FIG. 15(*c*).

Therefore, in the case of the first and second joining modules 31*a*, 31*b* provided to the flexible joint connecting device 3 according to the second embodiment of the present disclosure, if the joining module is lowered from top to bottom as shown in of FIG. 15(*c*) in a state where the lower portion of the outer frame member is opened, the precast concrete segment is inserted into the open lower portion of the outer frame member, and the outer frame member surrounds the upper and side surfaces of the precast concrete segment. Subsequently, the lower portion of the outer frame member of the joining module is closed while sequentially changing to the states shown in FIGS. 15(*b*) and 15(*a*). In order to close the lower portion of the outer frame member, both the first expansion jack 37 and the second expansion jack 38 are expanded. Accordingly, the rotating hinge link 351 descends in the vertical direction in a state of being inserted into the elongated hole 350. In addition, as the protruding part of the bottom opening/closing beam 39 is pulled down due to the expansion of the second expansion jack 38, the opening/closing beam 39 rotates to become horizontal by the seesaw operation. The opening/closing beams 39 provided at both sides of the outer frame member of the joining module rotates to become horizontal in the lateral direction while changing from the state of FIG. 15(*c*) to the state of FIG. 15(*b*), and to the state of FIG. 15(*a*), opposite to that described above, thereby intersecting the lower surface of the precast concrete segment. Accordingly, the precast concrete segment becomes completely surrounded by the joining module.

The operation of the flexible joint connecting device 3 according to the second embodiment of the present disclosure may be performed under water. Therefore, if the flexible joint connecting device 3 according to the second embodiment of the present disclosure is used, when constructing an underwater tunnel according to the construction method of the present disclosure described above, it is not needed to install the joining module of the flexible joint connecting device 3 at the precast concrete segment in advance, but the joining module may be installed at any time when necessary. Therefore, it is possible to use the flexible joint connecting device 3 at a proper place and at any time during the construction process, which gives an advantage of securing fluidity and autonomy in performing construction stages for an underwater tunnel.

In particular, in constructing an underwater tunnel according to the construction method of the present disclosure, after the end portion 1 and the first tunnel module 21 are connected and joined together in a perfect watertight manner, or after the tunnel modules are connected and joined together in a perfect watertight manner, the flexible joint connecting device 3 is no longer necessary. After the joining module is installed, the flexible joint connecting device 3 according to the first embodiment shown in FIGS. 7 to 12 can be removed only by cutting the outer frame member of the joining module, and, otherwise, the flexible joint connecting device 3 must be sacrificed without being removed. However, in the case of the flexible joint connecting device 3 according to the second embodiment of the present disclosure, the lower portion of the outer frame member of the joining module is in a completely open state by the contracting operation of the first expansion jack 37 and the second expansion jack 38 as described above, and the flexible joint connecting device 3 is separated from the precast concrete segment by raising the joining module so that the precast concrete segment is separated from the open lower portion of the outer frame member. The flexible joint connecting device 3 according to the second embodiment of the present disclosure may be easily separated and removed when it is no longer necessary. Therefore, it is possible to reduce the cost and resource consumption caused by the sacrifice of components, and there is an advantage that the overall underwater tunnel construction cost is reduced. The work for installing and separating the flexible joint connecting device 3 as described above may be performed by remote control on water.

INDUSTRIAL APPLICABILITY

The present disclosure may be very useful for constructing an underwater tunnel.

What is claimed is:

1. A flexible joint connecting device (3) for temporarily connecting precast concrete segments (2) to each other in order to construct an underwater tunnel, comprising:

first and second joining modules (31*a*, 31*b*) respectively coupled to a pair of precast concrete segments (2) facing each other and connected to each other by an expansion/contraction device (32), wherein each of the first and second joining modules (31*a*, 31*b*) is integrally coupled to the precast concrete segment (2) while surrounding an outer side of the precast concrete segment (2), wherein the expansion/contraction device (32) is an expandable and shrinkable member that is longitudinally disposed between the first and second joining modules (31*a*, 31*b*) facing each other, wherein the first joining module (31*a*) includes a hinge fixing member (320) so that one end of the expansion/contraction device (32) is hinged to the hinge fixing member (320) to be vertically rotatable, wherein the second joining module (31*b*) includes an end fastening member (321) that is vertically rotatable, and wherein as the pair of precast concrete segments (2) approach toward each other, the other end of the expansion/contraction device (32) is fastened to the end fastening member (321) so that the first and second joining modules (31*a*, 31*b*) are integrally connected by the expansion/contraction device (32), whereby the pair of precast concrete segments (2) respectively having the first and second joining modules (31*a*, 31*b*) are connected to be vertically bendable with respect to each other, and, when the expansion/contraction device (32) is contracted, the precast concrete segments (2) are pulled toward each other so that ends thereof come into contact.

2. The flexible joint connecting device according to claim 1, wherein the first and second joining modules (31*a*, 31*b*) is configured to include an outer frame member in which a pair of bent frame members (35) having a "⌊" shape, which is rotated by 90 degrees such that an open portion is oriented downward, are positioned to face each other with an interval in a longitudinal direction and are integrated with each other by a crosslinking member (36), wherein a first expansion jack (37) and a second expansion jack (38) connected to be rotatable with respect to each other by a rotating hinge link (351) are positioned between the pair of bent frame members (35) at both lateral sides of the outer frame member, wherein the rotating hinge link (351) is configured to be movable along the vertical portion of the bent frame (35), wherein the other end of the first expansion jack (37) is rotatably coupled to a top of the vertical portion of the bent frame member (35), wherein a bottom opening/closing beam (39) made of a beam member extending laterally is rotatably coupled to the bottom of the vertical portion of the bent frame member (35) so that the bottom opening/closing beam (39) protrudes outward further to the vertical portion of the bent frame member (35), wherein a bottom end of the second expansion jack (38) is rotatably coupled to the protruding portion of the bottom opening/closing beam (39), and wherein when each of the first and second joining modules (31*a*, 31*b*) is coupled to the precast concrete segment (2), both the first expansion jack (37) and the second expansion jack (38) are contracted to move the opening/closing beam (39) to an opening location so that a lower portion of the outer frame member is opened, then the joining module is moved downward so that the precast concrete segment is inserted into the open lower portion of the outer frame member, and then both the first expansion jack (37) and the second expansion jack (38) are expanded to horizontally rotate the opening/closing beam (39) so that the precast concrete segment is completely surrounded by the joining module; and when each of the first and second joining modules (31*a*, 31*b*) is separated from the precast concrete segment (2), both the first expansion jack (37) and the second expansion jack (38) are contracted to move the opening/closing beam (39) to an opening location so that the lower portion of the outer frame member is opened, and then the joining module is moved upward so that the precast concrete segment deviates from the open lower portion of the outer frame member.

3. A method of constructing an underwater tunnel by coupling precast concrete segments (2), comprising:

forming a tunnel module by integrally connecting a plurality of floating precast concrete segments (2) in a state where both longitudinal ends of the precast concrete segments (2) are sealed, wherein a plurality of tunnel modules are formed to float and are temporarily connected to each other by a flexible joint connecting device (3) that allows vertical displacement;

submerging a first tunnel module (21) positioned close to a end portion (1) in water among the plurality of tunnel modules;

when a rear end of the submerged first tunnel module (21) faces the end portion (1), temporarily connecting the rear end of the first tunnel module (21) to the end portion (1) by using the flexible joint connecting device (3);

submerging a second tunnel module (22) successive to the first tunnel module (21) in water;

connecting and joining the end portion (1) and the first tunnel module (21) in a perfect watertight manner to be integrated; and submerging a third tunnel module (23) successive to the submerged second tunnel module (22) in water, and connecting and joining two precast concrete segment assemblies in a perfect watertight manner to be integrated, which is repeated such that a plurality of tunnel modules are integrally coupled to construct an underwater tunnel, wherein the flexible joint connecting device (3) for temporarily connecting the tunnel modules and temporarily connecting the rear end of the first tunnel module (21) to the end portion (1) is configured to include first and second joining modules (31*a*, 31*b*) respectively coupled to a pair of precast concrete segments (2) facing each other of the tunnel modules to be temporarily connected and connected to each other by an expansion/contraction device (32), wherein each of the first and second joining modules (31*a*, 31*b*) is integrally coupled to the precast concrete segment (2) while surrounding an outer side of the precast concrete segment (2), wherein the expansion/contraction device (32) is an expandable and shrinkable member that is longitudinally disposed between the first and second joining modules (31*a*, 31*b*), and the first joining module (31*a*) includes a hinge fixing member (320) so that one end of the expansion/contraction device (32) is hinged to the hinge fixing member (320) to be vertically rotatable, wherein the second joining module (31*b*) includes an end fastening member (321) that is vertically rotatable, and wherein as the pair of precast concrete segments (2) facing each other of the tunnel modules to be temporarily connected approach toward each other, the other end of the expansion/contraction device (32) is fastened to the end fastening member (321) so that the first and second joining modules (31*a*, 31*b*) are integrally connected by the expansion/contraction device (32), whereby the pair of precast concrete segments (2) respectively having the first and second joining modules (31*a*, 31*b*) are connected to be vertically bendable with respect to each other, and, when the expansion/contraction device (32) is contracted, the precast concrete segments (2) are pulled toward each other so that ends thereof come into contact.

4. An underwater tunnel constructed by sequentially connecting precast concrete segments in water, the precast concrete segments having a hollow through which vehicles or pedestrians pass, wherein the underwater tunnel has a structure in which the precast concrete segments constructed according to the method of claim 3 are successively connected.

* * * * *